US005407065A

United States Patent [19]

Sutherland

[11] Patent Number: 5,407,065

[45] Date of Patent: Apr. 18, 1995

[54] BOTTLE NECK CARRIER

[75] Inventor: Robert L. Sutherland, Kennesaw, Ga.

[73] Assignee: Riverwood International Corporation, Atlanta, Ga.

[21] Appl. No.: 205,683

[22] Filed: Mar. 2, 1994

[51] Int. Cl.[6] ..... B65D 75/00

[52] U.S. Cl. ..... 206/148; 206/147; 206/427

[58] Field of Search ..... 206/145, 147, 148, 149, 206/151, 161, 194, 199, 429, 427

[56] References Cited

U.S. PATENT DOCUMENTS

| | | | |
|---|---|---|---|
| 3,398,856 | 8/1968 | Graser | 206/148 |
| 3,687,282 | 8/1972 | Owen | 206/194 |
| 4,190,149 | 2/1980 | Oliff . | |
| 4,304,329 | 12/1981 | Graser | 206/148 |
| 4,732,316 | 3/1988 | Oliff et al. | 206/427 |
| 5,058,735 | 10/1991 | Bienaimé | 206/145 |
| 5,163,548 | 11/1992 | Domansky | 206/147 |
| 5,246,112 | 9/1993 | Stout et al. | 206/147 |

FOREIGN PATENT DOCUMENTS

| | | | |
|---|---|---|---|
| 706243 | 3/1965 | Canada | 206/148 |
| 2093434 | 9/1982 | United Kingdom | 206/145 |
| 9314992 | 8/1993 | WIPO | 206/152 |

*Primary Examiner*—David T. Fidei

[57] ABSTRACT

A bottle neck carrier with partial side and end panels. The end panels extend around the corner bottles in the package and underlie the side panels. Gusset panels connecting the side and end panels to assist in holding the panels in place and to facilitate folding of the side panel flaps. The outer support tabs at the bottle openings are connected to the support panel of the carrier by fold lines which are coincident with the fold lines connecting the support panel to the side and end panels.

14 Claims, 3 Drawing Sheets

BOTTLE NECK CARRIER

FIELD OF THE INVENTION

This invention relates to bottle carriers of the type that employ foldable tabs to engage the underside of bottle flanges. More particularly, it relates to carriers of this type which have partial side and end panels.

BACKGROUND OF THE INVENTION

Certain types of articles, such as food or beverage containers, are commonly sold either as individual units or in a multi-container carton. Each article is normally marked with a pricing code to enable it to be scanned and automatically totaled at a retail outlet when sold as an individual item. When packaged in conventional open-ended wrap-around carriers, pricing errors can occur if the scanner sees the pricing code on one of the articles instead of the code on the package itself. One way to prevent this from happening is to package the articles in a completely enclosed carton or carrier. An enclosed carrier is quite expensive, however, due to the greater amount of stock required. Another way is to package the articles in wrap-around carriers having partial end panels of a size sufficient to cover the pricing code on the end articles in the package. Although such a design requires less stock than a fully enclosed carrier and is more economical to produce, the cost is still too great for certain markets. Further, while the design of a wrap-around carrier permits a short end panel extending up from the bottom panel to cover pricing codes located near the bottom of the end articles, this would not be practical for articles whose pricing codes are located more centrally or even higher. It would be preferable in those cases to provide a partial end panel extending down from the top panel. The requirements of such a design is that the partial end panels be minimal in size, not interfere with the fabrication and packaging methods of the carrier, and be locked in place after being formed.

A more economical carrier for beverage bottles is the bottle neck carrier that employs so-called starburst support tabs surrounding the bottle neck openings in a carrier support panel. These tabs support the bottles by contacting the underside of the flange or shoulder that projects out from the bottle neck. Such carriers, however, do not lend themselves to the provision of partial side and end panels to cover pricing codes. In addition, if the bottles rotate while the package is being carried, the user often perceives them to be swinging, suggesting less than adequate support.

It is an object of the invention to provide a bottle neck carrier which covers the pricing code of the bottles. Another object is to provide a carrier of this type which snugly holds the bottles in place to prevent them from rotating.

BRIEF SUMMARY OF THE INVENTION

The invention is incorporated in a bottle neck carrier which includes support tabs extending up from the periphery of bottle openings in a support panel. The support tabs engage the underside of an outwardly projecting shoulder on the bottles to support the bottles in conventional fashion. In addition, the carrier includes side and end panels foldably connected to the support panel and gusset panels foldably connected to adjacent side and end panels. The gusset panels and end portions of the end panels underlie and are adhered to the side panels, and end portions of the end panels extend around, and conform to the curvature of, adjacent bottles.

Preferably, cutouts are provided in the end panels, with portions of the cutout periphery defining edges of the gusset panels and the side panels. Also, the outer support tabs are preferably connected to the support panel along fold lines which are substantially coincident with the fold lines connecting the support panel to the side and end panels. In addition, the outer support tabs adjacent the side panels are preferably of greater height than the opposite tabs of the bottle neck opening to compensate for lifting stresses.

The carrier is inexpensive to produce and apply, yet not only has side and end panels which cover the pricing code on the bottles but is capable of snugly holding the bottles in place to prevent rotation during carrying. The features which enable the carrier to function in this manner are brought out in more detail in connection with the description of the preferred embodiment, wherein the above and other aspects of the invention, as well as other benefits, will readily become apparent.

DETAILED DESCRIPTION OF THE PREFERRED EMBODIMENT

Figure 1:
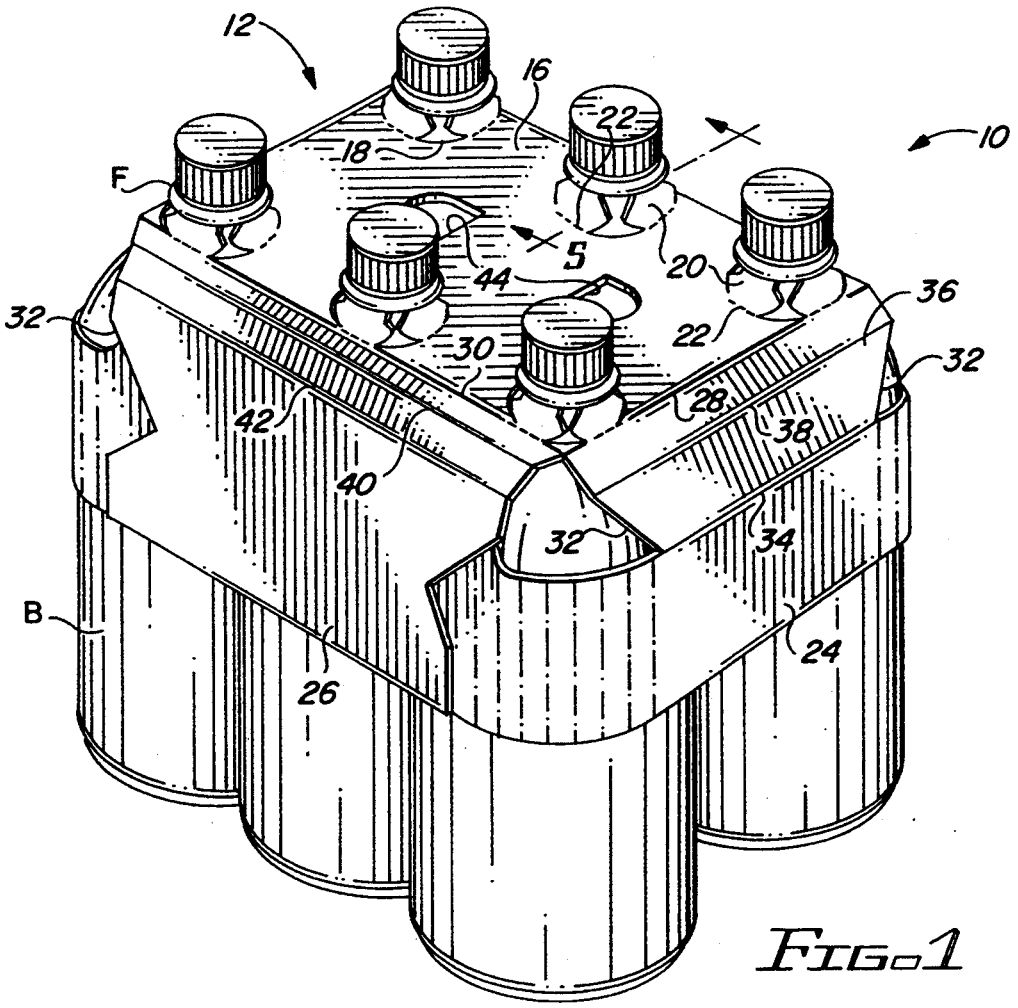
FIG. 1 is a pictorial view of the carrier of the invention.

Referring to FIG. 1, the package 10 is comprised of two rows of three bottles B and a carrier 12 for lifting and carrying the bottles. The carrier includes a support panel 16 containing openings 18 through which the necks of the bottles extend. The end edges of tabs 20, which are connected to the panel 16 by fold lines 22 extending about the periphery of the bottle neck openings 18, contact the underside of the flanges F on the bottles to support the bottles when the carrier is lifted. The support panel 16 is connected to end panels 24 and side panels 26 by fold lines 28 and 30, respectively, which meet at the corners of the carrier. Corner cutouts 32 extend down from the intersection of the fold lines 28 and 30, and fold lines 34 in the end panels 24 extend between the lower edges of the cutouts 32, forming sloped end panel sections 36 which generally conform to the slope of the bottles in the transition area between the bottle neck and the barrel of the bottle. An additional fold line 38 in the sloped panel sections 36 and additional spaced fold lines 40 and 42 in the side panels allow the side and end panels to more closely conform to the contour of the bottles. The fold lines 34 and 38 are parallel to the fold lines 28. Similarly, the fold lines 40 and 42 are parallel to the fold lines 30.

This construction produces a carrier having short side and end panels which extend down to a point sufficient to cover the pricing code on the bottles, and having rounded corner areas adjacent the corner bottles.

Finger holes 44 in the support panel 16 function as a handle to allow the carrier to be lifted.

Figure 2:
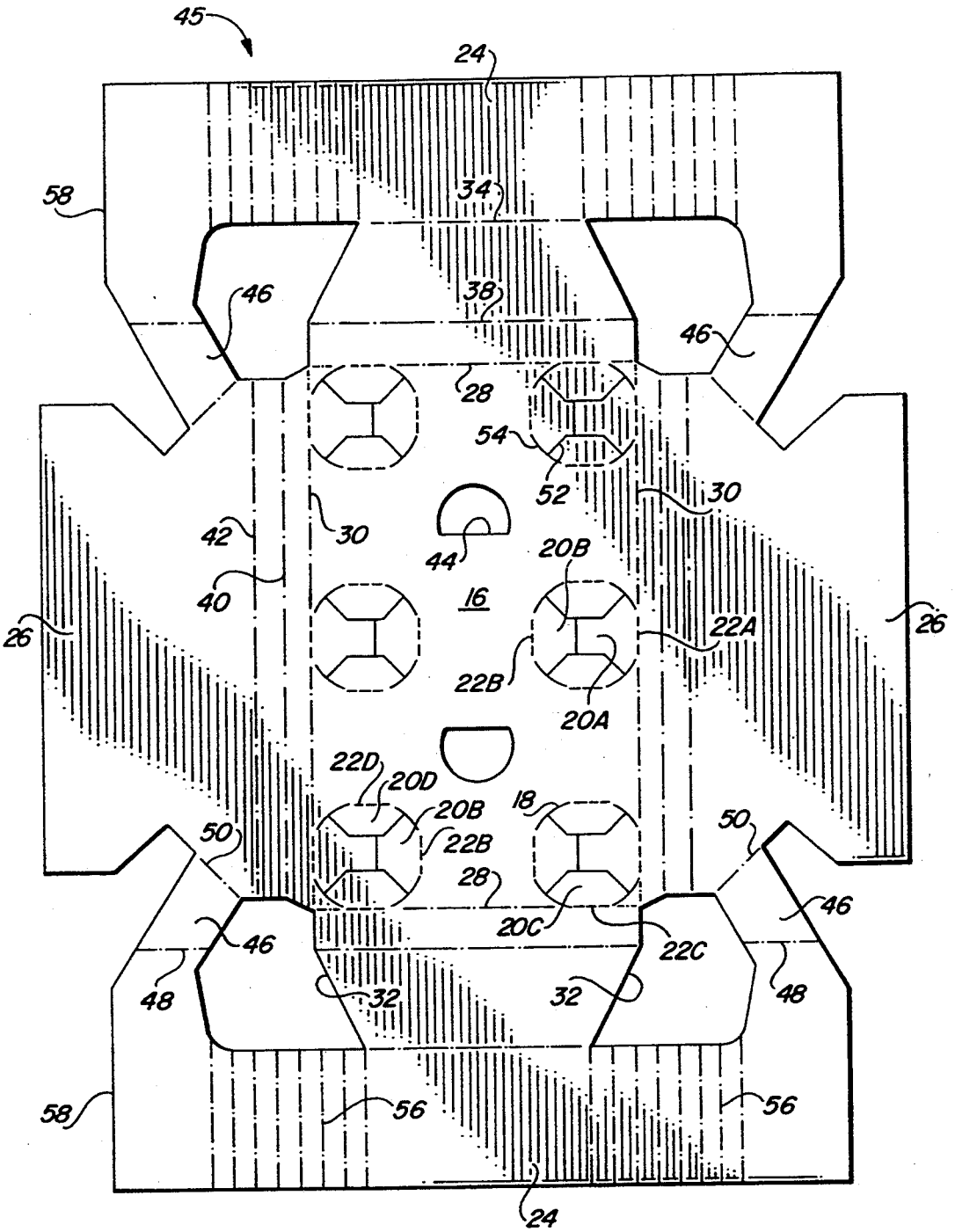
FIG. 2 is a plan view of a blank for forming the carrier of FIG. 1.

A blank 45 for forming the carrier is shown in FIG. 2, wherein like reference numerals to those used in FIG. 1 denote similar elements. The blank is preferably formed of paperboard, but may be of any suitable material having sufficient strength and flexibility to function in the manner of paperboard. The blank is comprised of a central section 16 corresponding to the support panel and two relatively long oppositely located flaps 24 corresponding to the end panels. Relatively short flaps 26, corresponding to the side panels, are located between the end panel flaps 24. The end flaps 24 are connected to the support panel section along fold lines 28, while the side flaps 26 are connected along fold lines 30. The end panel flaps 24 are longer than the width of the support panel section 16, terminating beyond the cutouts 32, while the ends of the side panel flaps 26 are shorter than the length of the support panel section. Gusset panels 46 connect the end panel flaps 24 to the side panel flaps 26 along fold lines 48 and 50, respectively, with the fold line 48 being substantially parallel to the fold lines 28 and the fold line 50 forming an angle of 45° with the fold lines 30 and 48.

As is conventional, the diameter of the bottle openings 18 in the support panel section 16 is related to the diameter of the neck portion of the bottles to be packaged so that the shoulder or flange of the bottle neck is able to pass through the opening while contacting the support tabs 20 to pivot them up about their fold lines. The support tabs 20 comprise four contiguous tabs arranged so that the fold lines of adjacent tabs are at right angles to each other. Slits 52, extending at 45° to the adjacent tab fold lines, separate the tabs and arcuate slits 54 separate the tab fold lines. The height of the tabs 20A adjacent the side panel flaps 26, as measured from its fold line 22A to its opposite support edge, is greater than the height of the opposite tab 20B for the reason explained below. In addition, the fold lines 22A of the tabs 20A coincide with the fold lines 30, while the fold lines 22C of the tabs 20C, which are adjacent the end panels 24, coincide with the fold lines 28. The fold lines 22B and 22D of the inner tabs 20B and 20D, respectively, are thus located in the interior of the support panel 16.

The blank 45 further includes groups of parallel score lines 56 in the end panel flaps 24. These score lines are parallel to the fold lines 30 and extend from the cutouts 32 to the edge of the end panel flaps.

Figure 3:
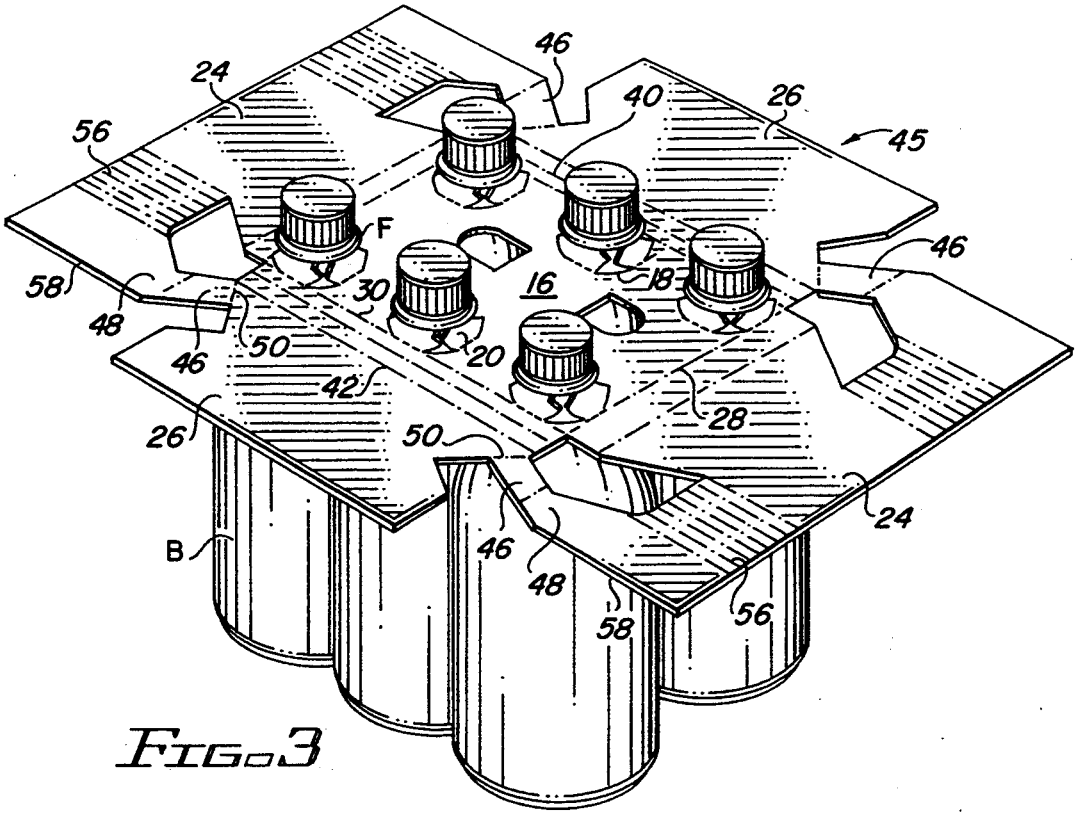
FIG. 3 is a pictorial view of the initial stage of carrier formation, showing the blank after it has been attached to the bottles.

To form a package, the bottles to be packaged are grouped together and the blank 45, after being properly aligned, is pushed down over the tops of the bottles. The upper portions of the bottles move through the openings 18 in the support panel section 16, pivoting the support tabs 20 up until they snap into place as the edges of the tabs engage the underside of the bottle flanges F. The blank at this stage is illustrated in FIG. 3. Next, the gusset panels 46 are folded down about fold lines 50 and up about fold lines 48 so as to contact the underside of the side panel flaps 26. It may be preferred during this step to pivot the side panel flaps 26 up about their fold lines 42 to the vertical, which elevates the fold lines 50 and causes the end panel flaps to fold down about the fold lines 28, thereby facilitating the folding of the gusset panels.

Figure 4:
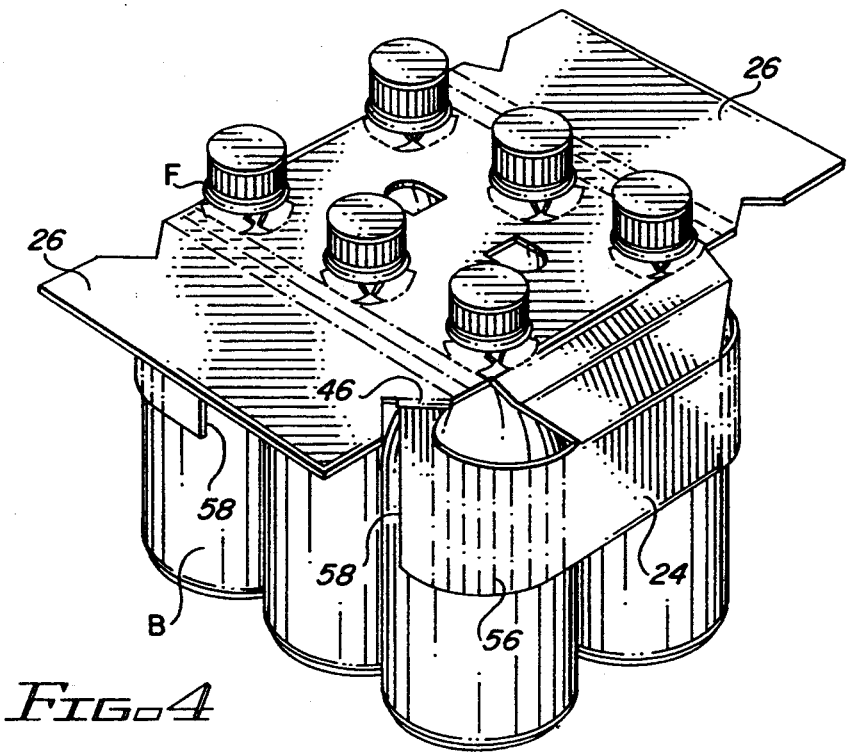
FIG. 4 is a pictorial view of an interim stage of carrier formation, showing the end panels of the blank in folded condition.

As a result of the folding of the gusset panels, the gusset fold lines 48 are brought to a position which is substantially parallel to the fold lines 30, 40 and 42. In the illustrated design the gusset fold lines 48 are substantially aligned with the fold lines 40. This could vary in other designs which, depending on the shape of the bottles, may not include intermediate fold lines such as fold lines 40. The end edges 58 of opposite end panel flaps 24 are moved toward each other during this folding sequence, causing the end portions of the end panel flaps to curve around the adjacent bottles until they are in their final spaced vertical position. The carrier at this interim stage of fabrication is illustrated in FIG. 4. The side panel flaps 26 are then folded down and glued to the underlying portions of the end panel flaps 24 to produce the final package shown in FIG. 1.

The score lines 56 facilitate the curving of the end panel flaps 24 about the corner packaged bottles. Because the flaps follow the contour of the bottles instead of meeting in a folded corner arrangement spaced from the adjacent bottle, the bottles are snugly held in place. The cutouts 32 at the corners of the package eliminate material which would tend to be compressed into unsightly irregular creases and folds when the panel flaps 24 are folded into place, and minimize the size of the gusset panels. They also provide biting edges which contact the bottles, further preventing the bottles from moving. Although relatively large cutouts provide these beneficial results, including minimizing the length of the gusset fold lines 48 in order to reduce resistance against folding of the gusset panels, the gusset fold lines 50 should remain of a length which provides enough force to pull the side panel flaps 24 into place upon folding of the gusset panels. The gusset panels cause the end panels to move into place so as to snugly conform to the curvature of the corner bottles in the package and maintain the end panels in that position prior to gluing the side panels to the end portions of the end panels.

Figure 5:
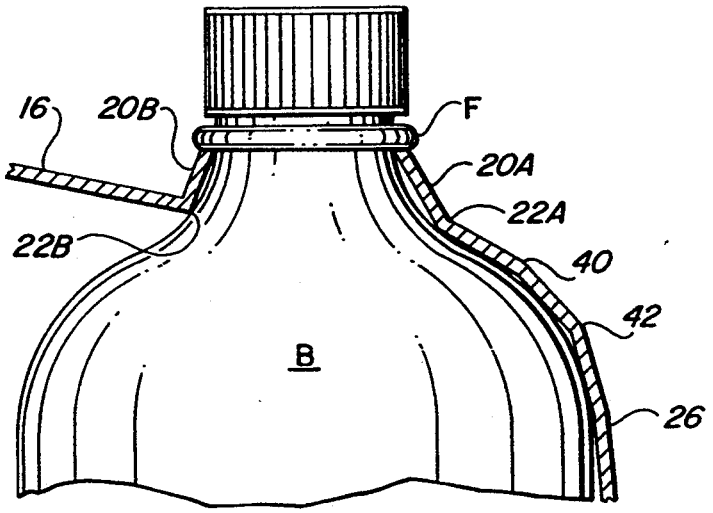
FIG. 5 is an enlarged partial transverse sectional view taken along line 5—5 of FIG. 1.

When the carrier is lifted, it tends to bow up in the middle, with the bow extending generally along the length of the carrier. The greater height of the tabs 20A than the tabs 20B accommodates the bowing of the carrier by maintaining the bottle flanges in generally horizontal condition even though the fold lines of the innermost tabs are higher due to the bowing than the fold lines of the outermost tabs. This is depicted in FIG. 5. If the outer tabs 20A were not made slightly higher, there could be a gap between the outer tab edges and the bottle flange when the carrier is lifted, with possible loss of support at this point of the flange. Because the outer tabs 20A and 20C are foldably connected at the fold lines between the support panel and the side and end panels, lifting stresses at these critical locations are distributed directly to these fold lines without first having to travel through part of the support panel, and so add to the strength of the carrier.

Although the bottles have been shown as having a separate integral flange, the terms "flange" or "shoulder" as used in the specification and claims are intended to include the underside of bottle caps in bottles which do not incorporate an integral flange. Also, although the panels that curve around the corner bottles in the package have been designated as "end" panels because they are connected to the shorter dimension of the support panel, it will be understood that either pair of opposite panels may be considered as the end or side panels in a carrier whose support panel is square. It is preferred, in carriers whose support panel is longer than it is wide, to connect the panel that curves around the corner bottles to the width of the support panel since the shorter the fold line connecting the panel to the support panel the less resistance there is to downward folding of the panel.

It can now be appreciated that the invention provides a unique support carrier having partial side and end panels which extend down as far as necessary in order to cover and block the pricing code on individual bottles. In addition, the carrier is capable of supporting the bottles so firmly that rotation of the bottles in the package is prevented. The features enabling the carrier to function in this way are incorporated into the carrier without requiring expensive carrier blanks or complicated maneuvers by packaging machines. It will be understood that the invention is not limited to all the specific details described in connection with the preferred embodiment, except as they may be within the scope of the appended claims. Changes to certain features of the preferred embodiment which do not alter the overall basic function and concept of the invention are therefore contemplated.

What is claimed is:

1. A carrier package for bottles having a neck which includes an outwardly projecting shoulder, comprising:

a support panel containing aligned openings through which the necks of the bottles extend;

a plurality of support tabs connected to the support panel by fold lines extending along portions of the periphery of each bottle opening, the support tabs having edges engaging the underside of the bottle shoulders;

opposite side panels connected to the support panel by first fold lines;

opposite end panels connected to the support panel by second fold lines;

the end panels having end portions which extend about outer curved portions of adjacent bottles;

each end portion of the end panels being connected by a fold line to a gusset panel; and each gusset panel being connected by a fold line to an associated side panel, the gusset panels and end portions of the end panels underlying and being adhered to the side panels.

2. A blank for forming a carrier for supporting bottles having a neck which includes an outwardly projecting shoulder, comprising:

a support panel section having opposite side edges and opposite end edges, the support panel section containing openings for receiving the necks of the bottles;

a plurality of support tabs connected to the support panel section by fold lines extending along portions of the periphery of each bottle opening, the support tabs having edges which engage the underside of the shoulders of bottles in a carrier formed from the blank;

side panel flaps connected to the side edges of the support panel section by first fold lines;

end panel flaps connected to the end edges of the support panel section by second fold lines;

the end panel flaps having end portions extending beyond the second fold lines, said end portions extending about outer curved portions of adjacent bottles in a carrier formed from the blank;

each end portion of the end panel flaps being connected by a fold line to a gusset panel and each gusset panel being connected by a fold line to an adjacent side panel flap, the gusset panels and end portions of the end panel flaps underlying and being adhered to the side panel flaps in a carrier formed from the blank.

3. A carrier package according to claim 1, wherein the fold lines connecting the gusset panels to the end portions of the end panels are substantially aligned with the first fold lines.

4. A carrier package according to claim 3, wherein the fold lines connecting the gusset panels to the side panels are transverse to the first and second fold lines.

5. A carrier package according to claim 4, wherein the fold lines connecting the gusset panels to the side panels extend at an angle of substantially 45° to the first and second fold lines.

6. A carrier package according to claim 4, including a plurality of cutouts in corner areas of the carrier.

7. A carrier package according to claim 6, wherein the first and second fold lines meet at points on the periphery of the cutouts.

8. A carrier package according to claim 7, wherein the end portions of the end panels include spaced substantially vertical score lines beneath the cutouts.

9. A carrier package according to claim 1, wherein the support panel includes one or more handle openings therein.

10. A carrier blank according to claim 2, wherein the fold lines connecting the gusset panels to the end portions of the end panel flaps are substantially aligned with the second fold lines.

11. A carrier blank according to claim 10, wherein the fold lines connecting the gusset panels to the side panel flaps extend at an angle of substantially 45° to the first and second fold lines.

12. A carrier blank according to claim 2, including a plurality of cutouts, the cutouts having a periphery part of which extends into the end panel flaps and other parts of which define edge portions of the gusset panels and the side panel flaps.

13. A carrier blank according to claim 12, wherein the first and second fold lines meet at points on the periphery of the cutouts.

14. A carrier blank according to claim 2, wherein the support panel section includes one or more handle openings therein.

* * * * *